US006622792B1

(12) United States Patent
Schick

(10) Patent No.: US 6,622,792 B1
(45) Date of Patent: Sep. 23, 2003

(54) APPARATUS AND METHOD FOR IMPROVING MULTILATERAL WELL FORMATION AND REENTRY

(75) Inventor: Robert C. Schick, The Woodlands, TX (US)

(73) Assignee: KMK Trust, The Woodlands, TX (US)

( * ) Notice: Subject to any disclaimer, the term of this patent is extended or adjusted under 35 U.S.C. 154(b) by 0 days.

(21) Appl. No.: 10/218,954

(22) Filed: Aug. 14, 2002

(51) Int. Cl.[7] ..... E21B 7/08

(52) U.S. Cl. ..... 166/313; 166/382; 166/384; 166/50; 166/117.6; 175/61

(58) Field of Search ..... 166/313, 381, 166/382, 384, 50, 117, 117.5–117.7; 175/61

(56) References Cited

U.S. PATENT DOCUMENTS

| | | | |
|---|---|---|---|
| 2,839,270 A | 6/1958 | McCune et al. | |
| 4,130,162 A | 12/1978 | Nelson | 166/243 |
| 4,304,299 A | 12/1981 | Holland et al. | 166/313 |
| 4,415,205 A | 11/1983 | Rehm et al. | 166/117.5 |
| 4,807,704 A | 2/1989 | Hsu et al. | 166/313 |
| 5,398,754 A | 3/1995 | Dinhoble | 166/117.6 |
| 5,467,819 A | 11/1995 | Braddick | 166/117.6 |
| 5,564,503 A | 10/1996 | Longbottom et al. | 166/313 |
| 5,615,740 A | 4/1997 | Comeau et al. | 166/380 |
| 5,704,437 A | 1/1998 | Murray | 175/61 |
| 5,735,350 A | 4/1998 | Longbottom et al. | 166/313 |
| 5,785,133 A | 7/1998 | Murray et al. | 175/61 |
| 6,012,527 A | 1/2000 | Nitis et al. | 166/313 |
| 6,070,667 A | 6/2000 | Gano | 166/313 |
| 6,427,777 B1 | 8/2002 | Schick | 166/313 |

OTHER PUBLICATIONS

FMC Energy Systems, Fluid Control Division, "Dynetor® Connectors"—Sales Brochure—Internet (Apr. 19, 2000) including Dynetor® Single–Nut Connectors and Dynetor® Double–Nut Connectors.

Bowen Unions, Bowen Blanking Plugs, Bowen High–Pressure Unions, Bowen High–Pressure Blanking Plugs, Apr. 9, 2000.

*Primary Examiner*—Roger Schoeppel
(74) *Attorney, Agent, or Firm*—Shook Hardy & Bacon

(57) ABSTRACT

An apparatus and method are disclosed for improving the formation of multiple lateral wells in a new wellbore and positive, selective reentry of each lateral well. The apparatus functions as an orienting sleeve which is attached to the lower end of the casing used to line the wellbore. The orienting sleeve includes a first end connected to one end of the casing, a second end having a plunger valve, a longitudinal reference point and a lateral reference point. The orienting sleeve cooperates with a sealing member and an orienting member. The sealing member is used to transfer cement from a surface above the wellbore to an area between the casing and the wellbore. The orienting member is used to effectively form multiple lateral wells through the casing or pre-formed openings in the casing. Thus, the orienting sleeve effectively secures the casing to the wellbore and improves the formation of multiple lateral wells using one or more pre-formed openings in the casing.

13 Claims, 5 Drawing Sheets

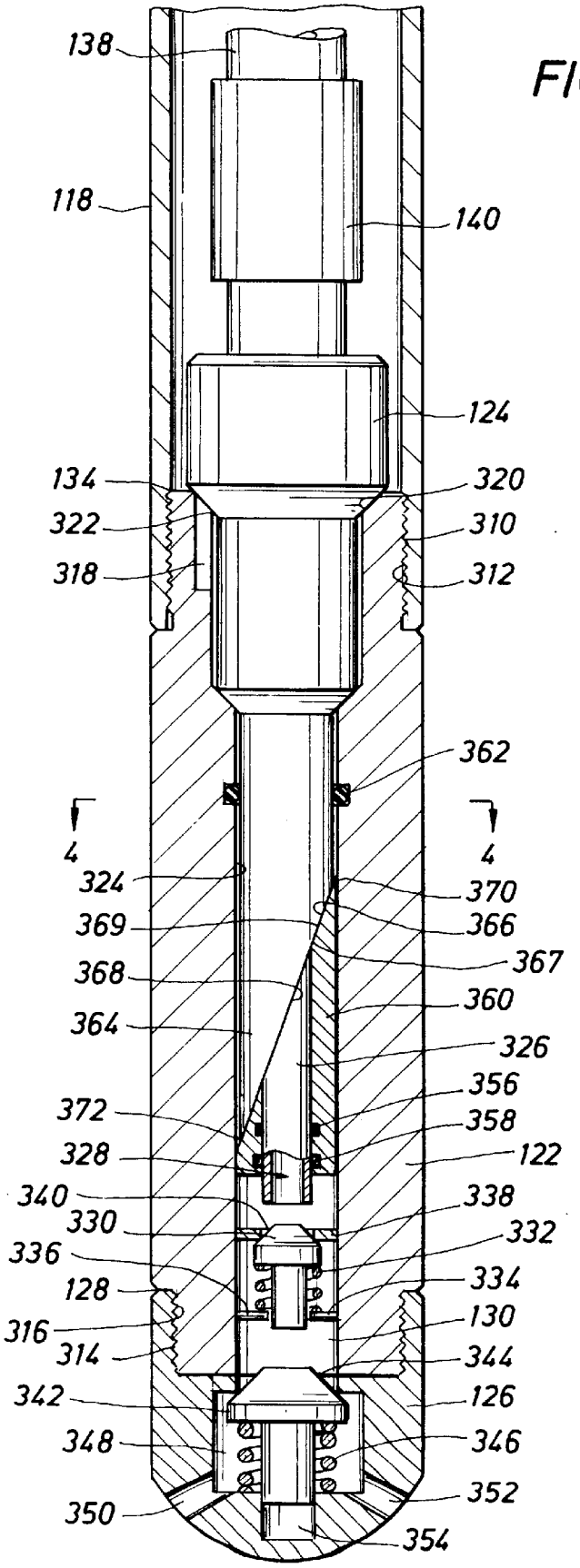
FIG. 3
FIG. 4
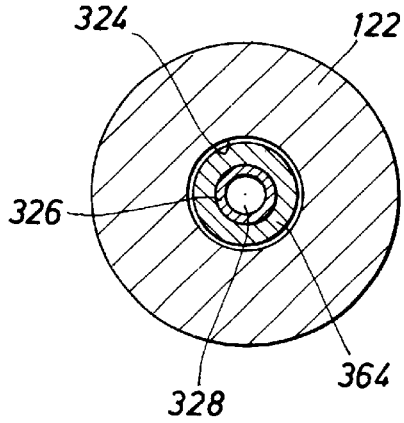

222
210
511
118
518
320
134
318
510
512
370
514
366
516
367
513
324
360
518
122
130
128
126

222
118
210
518
511
320
134
318
370
366
510
367
512
514
360
516
513
122
130
128
126

222
118
910
926
922
932
930
924
944
928
920
942
916
934
918
914
936
938
948
940
912
939
946
126

118
222
910
944
924
926
922
920
934
916
914
918
930
928
912
938
936
948
940
939
946
126

APPARATUS AND METHOD FOR IMPROVING MULTILATERAL WELL FORMATION AND REENTRY

CROSS-REFERENCE TO RELATED APPLICATIONS

This application and U.S. Pat. No. 6,427,777 are commonly assigned to KMK Trust, a Trust Set Up under the Laws of the State of Texas, Robert C. Schick, Sole Trustee.

STATEMENT REGARDING FEDERALLY SPONSORED RESEARCH

Not applicable.

FIELD OF THE INVENTION

The present invention is directed to an apparatus and method for improving the formation of multiple lateral wells in a new wellbore and positive, selective reentry of each lateral well.

BACKGROUND OF THE INVENTION

Several advantages are provided by drilling relatively high angle, deviated or lateral wells from a generally common wellbore such as a) access to the regular oil and gas reserves without additional wells being drilled from the surface, b) avoiding unwanted formation fluids, c) penetration of natural vertical fractures, and d) improved production from various types of formations or oil and gas reserves. Additionally, reentry of one or more lateral wells is often required to perform completion work, additional drilling, or remedial and stimulation work. Thus, lateral wells have become commonplace from the standpoint of new drilling operations and reworking existing wellbores.

Ordinarily, lateral well completion and/or reentry requires expensive downhole wireline surveys to accurately position the diverter or whipstock which is used to direct the boring or completion tool through a wall of a generally vertical wellbore into the adjacent formation. Without a survey, the lateral well formed may not be accurately recorded for purposes of reentry. For example, U.S. Pat. Nos. 4,304,299; 4,807,704; and 5,704,437 each describe a method and/or apparatus for producing lateral wells from a generally vertical common wellbore using conventional techniques and tools. In each instance, one or more lateral wells may be produced at a different depth and location in the common wellbore and reentered. Consequently, the whipstock must be repositioned at the new depth and location. Each time the whipstock is repositioned at a different depth and location, the change in depth and lateral orientation relative to a point of reference is recorded. In many applications using conventional threaded connections, the exact depth and location of each lateral well formed cannot be accurately or efficiently recreated using the same system and technique. As a result, a downhole directional survey is necessary to relocate the exact depth and location of each lateral well upon reentry.

Recognizing the disadvantages of the foregoing techniques, U.S. Pat. No. 2,839,270 and, more recently, U.S. Pat. No. 5,735,350 address the need for a more accurate method and/or apparatus for producing and reentering lateral wells without the need for a directional survey. For example, U.S. Pat. No. 2,839,270 describes a technique for selectively forming a lateral well through a wall of a common wellbore at a predetermined depth and lateral orientation by means of a supporting apparatus which includes apertures formed at predetermined locations in the supporting apparatus. The apertures determine the relative depth and lateral orientation of each lateral well and are prefabricated according to the particular common wellbore in which the supporting apparatus is installed. The whipstock is then positioned using one or more specially designed latches which engage a corresponding aperture designed for receipt of the respective latch.

Similarly, U.S. Pat. No. 5,735,350 describes a method and system for creating lateral wells at pre-selected positions in a common wellbore by means of a diverter assembly having a plurality of locator keys specially designed to engage a corresponding nipple formed in the wellbore casing having a unique profile. Although this technique may be employed in new and existing wells, it is expensive and, in some instances, inappropriate because the prefabricated keys and nipples are permanently and integrally formed according to the particular formation characteristics of the common wellbore in which the system is installed.

More recently, a system and method for use in a completed wellbore lined with casing was described in U.S. Pat. No. 6,427,777. This system uses a directional survey to position an anchor at a predetermined depth and lateral orientation relative to a longitudinal position and lateral position of the desired lateral well. Because a directional survey is used to position the anchor after the casing is set and secured, the exact location of a pre-formed opening in the casing is difficult to find. And, because the system is designed for completed wellbores, the system typically requires running equipment in the wellbore which is different than the equipment used to line and secure the wellbore with casing. Finally, the casing must be milled with a different type of bit than the bit used to drill through the formation when the system is used in a completed wellbore without pre-formed openings in the casing. As a result, the system must be run in the wellbore twice to form each lateral well.

SUMMARY OF THE INVENTION

It is therefore, an object of the present invention to provide an apparatus and method which can be used to secure the casing in a new wellbore and improve the formation of multiple lateral wells in a cost-efficient manner.

It is another object of the present invention to provide an apparatus and method which improves the formation and reentry of multiple lateral wells without the use of an anchor.

It is another object of the present invention to provide an apparatus and method which improves the accuracy of locating pre-formed openings in the casings.

It is an advantage of the present invention to provide an apparatus and method which reduces the time and cost associated with the formation of multiple lateral wells through the use of pre-formed openings in the casing.

It is an advantage of the present invention to provide an apparatus and method which can be used with conventional and/or standard equipment to secure the casing in a new wellbore and form multiple lateral wells.

It is another advantage of the present invention to provide an apparatus and method which is easy to install and operate within the wellbore.

In accordance with the foregoing objects and advantages, the present invention includes an apparatus, hereinafter referred to as an orienting sleeve, which is positioned in a wellbore lined with multiple casing segments. The orienting sleeve includes a first end connected to one of the casing segments, a second end, a longitudinal reference point and a lateral reference point.

A portion of the first end forms a seat. The valve is positioned in the second end of the orienting sleeve and permits movement of a fluid from the first end of the orienting sleeve to a second end of the orienting sleeve and restricts movement of the fluid from the second end of the orienting sleeve to the first end of the orienting sleeve. In order to improve the performance of the valve, the second end is connected to a float shoe which has another valve for permitting movement of the fluid from the first end of the orienting sleeve through the float shoe and restricting movement of the fluid from the wellbore through the float shoe. Alternatively, the second end of the orienting sleeve may be connected to a first end of another one of the casing segments which forms a reservoir for receipt of a portion of the fluid. A second end of the casing segment is connected to a float shoe having another valve for permitting movement of the fluid from the first end of the orienting sleeve through the float shoe and restricting movement of the fluid from the wellbore through the float shoe. As another alternative, the second end of the orienting sleeve includes another valve for permitting movement of the fluid from the first end of the orienting sleeve through the second end of the orienting sleeve and restricting movement of the fluid from the second end of the orienting sleeve to the first end of the orienting sleeve. Each valve utilized in the orienting sleeve or the float shoe is a plunger valve, however, may include any other type of valve capable of performing the function thus described.

A sealing member having a fluid passage therethrough is used to transfer the fluid from a surface above the wellbore through the orienting sleeve to a space between the casing segments and the wellbore. The fluid secures the casing segments to the wellbore. The orienting sleeve includes a seal to restrict the fluid from passing between the orienting sleeve and the scaling member.

The longitudinal reference point enables the location of a longitudinal position on at least one of the casing segments and the lateral reference point enables the location of a lateral position on the at least one of the casing segments. The lateral position and the longitudinal position define either an opening in at least one of the casing segments which is covered by a substantially impermeable material, or a desired region of interest in the formation adjacent to the lateral position and longitudinal position.

An orienting member and the orienting sleeve are used to effectively locate the lateral position and the longitudinal position of the opening in at least one of the casing segments. The sealing member and orienting member each include a shoulder which engages the seat on the orienting sleeve when the sealing member or orienting member is engaged with the orienting sleeve.

At least one of the sealing member and the orienting member includes a flange. The first end of the orienting sleeve includes a channel with an opening in the seat for receipt of the flange when the sealing member or the orienting member is aligned with the orienting sleeve. The channel extends toward the second end of the orienting sleeve. The flange substantially prevents rotational movement of the orienting member or the sealing member when the flange is disposed substantially within the channel.

The orienting sleeve includes a guide having a passage therethrough for receipt of a lower portion of the sealing member or the orienting member. The sealing member and the orienting member each include a reciprocating guide for alignment with the orienting sleeve when the guide and reciprocating guide are substantially engaged. In another embodiment, the orienting sleeve includes a key instead of a guide. Each of the respective sealing member and orienting member include a guide with a keyway for alignment with the orienting sleeve when the key enters the keyway. In either embodiment, the channel or the key defines the lateral reference point, and a portion of the orienting sleeve between the first end and the second end defines the longitudinal reference point. Preferably, the first end or the second end is chosen as the longitudinal reference point.

Thus, the sealing member and orienting sleeve are used to transfer the fluid, preferably cement, which secures the casing to the new wellbore. And, the orienting member and orienting sleeve are used to effectively form multiple lateral wells through the casing or pre-formed openings in the casing.

The present invention also includes a method to secure multiple casing segments within a new wellbore and improve the formation of multiple lateral wells through one or more of the casing segments, or one or more pre-formed openings in the casing segments, using the orienting sleeve, orienting member and sealing member thus described.

The method comprises the steps of: a) connecting the first end of the orienting sleeve to one end of a plurality of casing segments and connecting the second end of the orienting sleeve to a float shoe, b) lowering the casing segments, orienting sleeve and float shoe into the new wellbore until the orienting sleeve reaches a predetermined depth and lateral orientation, c) lowering the sealing member on a drill string until the sealing member is substantially engaged within the orienting sleeve, d) transferring a fluid through the drill string and sealing member from a surface above the wellbore to a space between the casing segments and the wellbore in order to secure the casing segments to the wellbore, e) removing the drill string and sealing member from the wellbore, f) lowering the orienting member on a drill string until the orienting member is substantially engaged within the orienting sleeve Once the orienting member is substantially engaged within the orienting sleeve, the process of forming a lateral well may be performed using the connections and related components described in reference to U.S. Pat. No. 6,427,777, incorporated herein by reference. By replacing the anchor with the orienting sleeve, the lateral reference point and longitudinal reference point may be used to accurately locate a pre-formed opening in the casing for each respective lateral well. As a result, the process of forming a lateral well through the casing is reduced to a single step and the need to mill through the casing is eliminated. Alternatively, however, the lateral reference point and longitudinal reference point may be used to accurately locate the lateral position and longitudinal position of each respective lateral well.

Although the terms longitudinal and lateral are used herein for convenience, those skilled in the art will recognize that the apparatus and method of the present invention may be employed with respect to wells which extend in directions other than generally vertically or horizontally.

The foregoing has outlined rather broadly the objects and advantages of the present invention so that those skilled in the art may better understand the detailed description of the invention that follows. Additional objects and advantages of the invention, which form the subject of the claims of the invention, will be described below. Those skilled in the art should appreciate that they may readily use the concept and specific embodiment disclosed as a basis for modifying or designing other structures for carrying out the same purposes of the present invention. Those skilled in the art should also realize that such equivalent constructions do not depart from the spirit and scope of the invention in its broadest form.

BRIEF DESCRIPTION OF THE DRAWINGS

For a better understanding of the nature of the present invention, reference is made to the following detailed description taken in connection with the accompanying drawings in which:

FIG. 3—is a detailed cross-sectional view of the orienting sleeve in substantial engagement with the sealing member shown in FIG. 1.

FIG. 4—is a cross-sectional view of the orienting sleeve and sealing member shown in FIG. 4 along 4—4.

DESCRIPTION OF PREFERRED EMBODIMENTS

Figure 1:
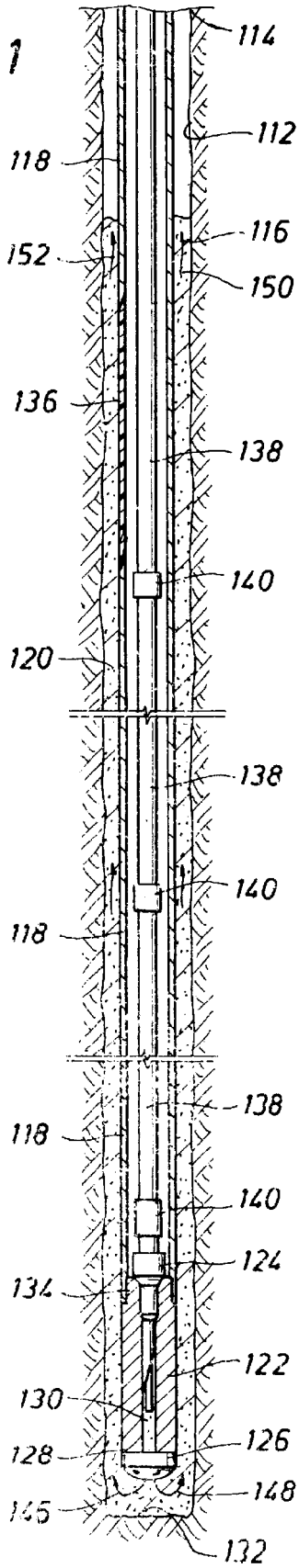
FIG. 1—is an elevational view of the orienting sleeve, shown in partial cross-section, and the sealing member.

In the description which follows, like parts are marked throughout this description in drawings with the same reference numerals, respectively. The drawing figures are not necessarily to scale. Certain features of the invention may be shown exaggerated, in scale or in schematic form, and some details of conventional elements may not be shown in the interest of clarity and conciseness.

Referring now to FIG. 1, the orienting sleeve 122, illustrated in partial cross-section, is shown substantially engaged with the sealing member 124. In this embodiment, the orienting sleeve 122 is shown within a new wellbore 112 which extends vertically to a surface 114. The wellbore 112 generally extends from the surface 114 through a formation region 116 where it may be desired to induce or inject fluids. The wellbore 112, however, may extend in other non-vertical directions approaching horizontal.

Figure 2:
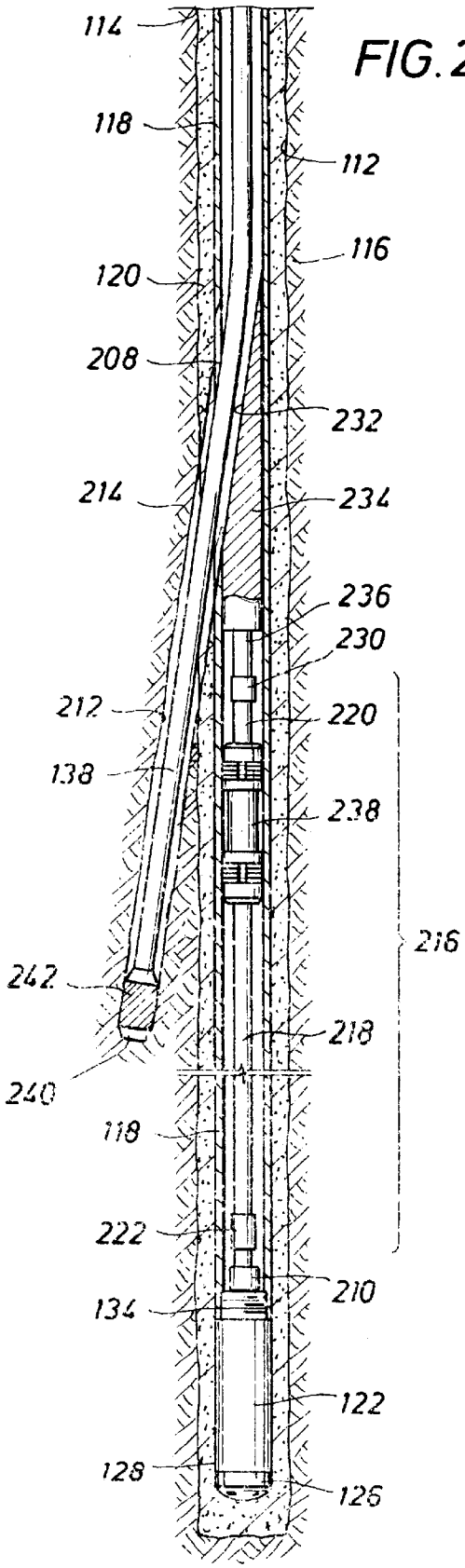
FIG. 2—is an elevational view of the orienting sleeve and orienting member.

The orienting sleeve 122 is connected to the lower end of the casing 118 before the casing and orienting sleeve 122 are lowered into position within the wellbore 112. Generally, the casing is comprised of multiple segments which are connected at the surface 114 as the casing 118 is lowed into the wellbore 112. Preferably, one or more of the segments include an opening 208 formed in a wall of the casing 118 as shown in FIG. 2. The opening 208 is defined by a longitudinal position and a lateral position on the casing 118. The opening 208 is covered by a fiberglass mesh 136 in FIG. 1. This material, however, may be made of any other substantially impermeable material.

Determining where to position the orienting sleeve 122 at an appropriate depth and lateral orientation within the wellbore 112 is accomplished by any conventional survey means such as a directional downhole survey of the formation 116. A conventional directional survey of the wellbore 112 generally will reveal the depth (longitudinal position) and lateral position of each region within the formation 116 where hydrocarbons may be found. Based upon the survey results, the appropriate number and location of lateral wells is determined and the segments comprising the casing 118 are made up to include one or more pre-formed openings—like the opening covered with fiberglass 136 in FIG. 1. Each segment of the casing 118 is made up so that each opening therein may be aligned with a corresponding area in the formation 116 where a lateral well is desired. Thus, the casing 118 and orienting sleeve 122 are made up and lowered into the wellbore 112 to a predetermined depth and lateral orientation which places each opening in the casing 118 in general alignment with a corresponding area in the formation 116 where a respective lateral well is desired. Conversely, if openings are not included in the casing 118, then the orienting sleeve 122 and casing 118 are made up and lowered to a predetermined depth and lateral orientation adequately below the area in the formation 116 where the lateral well furthest from the surface 114 is desired.

Figure 9:
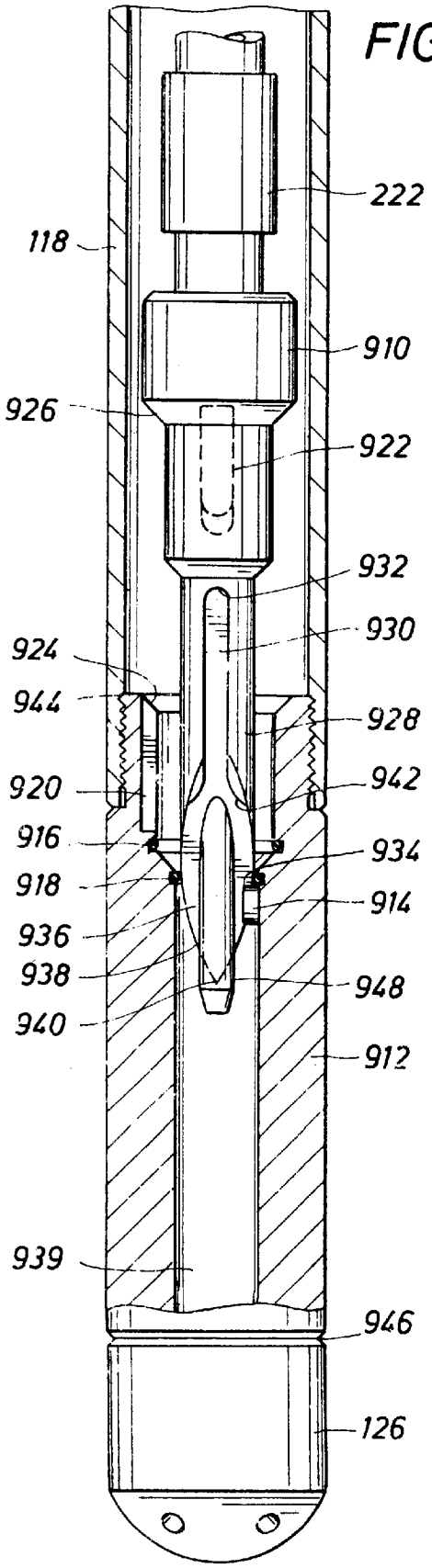
FIG. 9—is a detailed cross-sectional view of another embodiment of the orienting sleeve in partial engagement with another embodiment of the orienting member.
Figure 10:
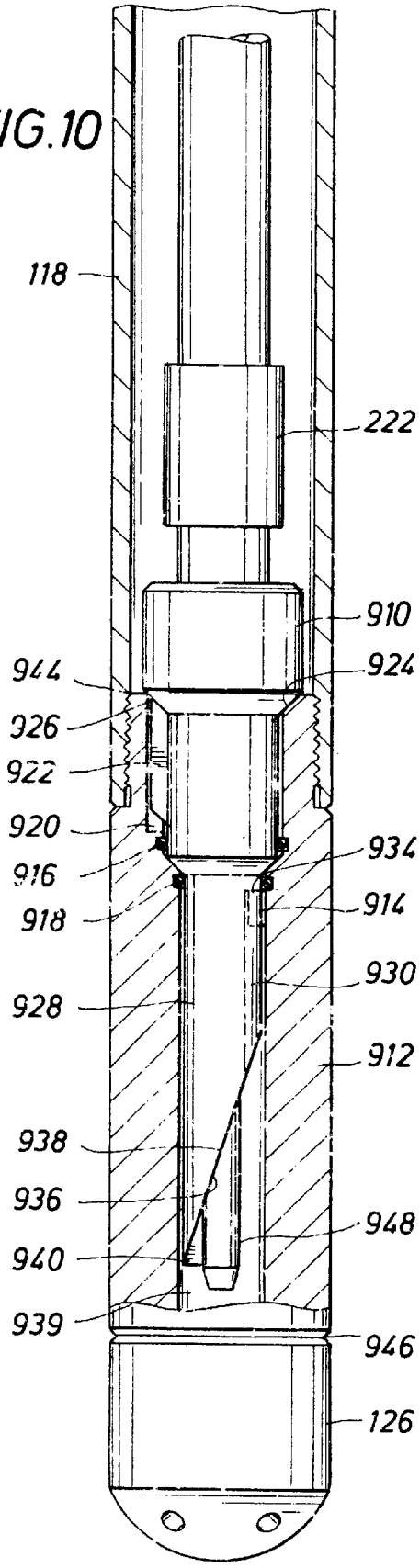
FIG. 10—is a detailed cross-sectional view of the orienting sleeve in substantial engagement with the orienting member shown in FIG. 9.

The orienting sleeve 122 includes a longitudinal reference point which is between the first end 134 and the second end 128 of the orienting sleeve 122, and a lateral reference point as more particularly described in reference to FIGS. 3, 9 and 10. The longitudinal reference point is preferably the first end 134 or the second end 128 of the orienting sleeve 122 which corresponds with the depth of the orienting sleeve 122 within the wellbore 112. Once the orienting sleeve 122 is secured, its depth and lateral orientation are recorded using the longitudinal reference point and lateral reference point as initial coordinates to locate each opening in the casing 118 and/or area in the formation 116 where a lateral well is desired. Each lateral position and longitudinal position disclosed by the directional survey is measured from the lateral reference point and longitudinal reference point in the manner described in reference to FIG. 2 to locate each opening in the casing 118 and/or an area in the formation 116 where a lateral well is desired.

Once positioned, the orienting sleeve 122 and casing 118 are secured within the wellbore 112 using any hardenable fluid material such as cement, which forms a cement liner 120 around the casing 118. The cement liner 120 is prepared at the surface 114 in a conventional manner and is transferred by means of a pump through a plurality of connected tubular components forming a drill string 138. The components comprising the drill string 138 are generally connected by a standard threaded coupling 140. The cement liner 120 is pumped through the drill string 138 and the sealing member 124. As the cement liner 120 exits the sealing member 124, it enters the orienting sleeve 122 and passes through a passage 130 which extends from the first end of the orienting sleeve 134 through the second end of the orienting sleeve 128. A float shoe 126 is connected to the second end of the orienting sleeve 128 which includes a plunger valve (not shown) more particularly described in reference to FIG. 3. After the cement liner 120 is pumped through the float shoe 126, it is forced to the bottom of the wellbore 132 and around the orienting sleeve 122 in the direction shown by arrows 146 and 148. Pressure from the pump forces the cement liner 120 to migrate up through the wellbore 112 in the direction indicated by arrows 150 and 152 until it reaches a desired position in the wellbore 112 relative to the surface 114. Once the cement liner 120 reaches this position, it will harden over time and secure the casing 118 and orienting sleeve 122 within the wellbore 112. The fiberglass cover 136 prevents the cement liner 120 from entering the opening 208 shown in FIG. 2.

Referring now to FIG. 3, a detailed cross-sectional view of the orienting sleeve 122 is shown in substantial engagement with a sealing member 124. The first end 134 of the orienting sleeve 122 includes external threads 310 for threaded engagement with the internal threads 312 of the casing 118. Similarly, the second end 128 of the orienting sleeve 122 includes external threads 314 for threaded engagement with the internal threads 316 of the float shoe 126. The first end 134 of the orienting sleeve 122 includes a channel 318 which extends toward the second end 128 of the orienting sleeve 122. The seat 320 supports the sealing member 124 or the orienting member 210 shown in FIG. 2.

The sealing member 124 includes a shoulder 322 for engagement with the seat 320. The passage 130 includes an internal diameter 324 large enough to receive at least a portion of the sealing member 124 or orienting member 210 shown in FIG. 2. The lower end 326 of the sealing member 124 includes a fluid passage 328 which opens into passage 130 of the orienting sleeve 122. The drill string 138 in FIG. 1 and passage 130 form a conduit through which the cement liner 120 is pumped.

A valve 330 is secured within the passage 130 by a spring 332 which rests on support brackets 334 and 336. A plate 338 is positioned in passage 130. The plate 338 and brackets 334, 336 are attached to the inside diameter 324 of the orienting sleeve.122 by any conventional means. The plate 338 includes an opening 340 for partial receipt of the valve 330. And, the brackets 334, 336 include a plurality of openings (not shown) which allow the cement liner 120 to pass therethrough. Brackets 334 and 336 support the spring 332 and allow the valve 330 to depress between the brackets 334, 336. The pressure of the cement liner 120 depresses valve 330, causing the cement liner 120 to pass through opening 340.

The float shoe 126 includes an opening 344 which communicates with passage 130. The opening 344 is large enough for receipt of a portion of the valve 342. The pressure of the cement liner 120 causes valve 342 to depress the spring 346, permitting the cement liner 120 to pass through opening 344 into chamber 348. Further pressure from the cement liner 120 causes cement contained in the chamber 348 to pass through openings 350, 352 in the float shoe 126 into the wellbore 112 as described in reference to FIG. 1. A portion of the float shoe 126 contains a bore 354 for receipt of a lower portion of the valve once the valve 342 is depressed and compresses the spring 346.

Alternatively, the second end 128 of the orienting sleeve 122 may be connected to a first end of another one of the casing segments (not shown). A second end (not shown) of the other casing segment is connected to a float shoe similar to float shoe 126. The other casing segment thus functions as a back-up reservoir for receipt of any excess portion of the cement liner 120 which may re-enter the float shoe from the wellbore 112. As another alternative, the second end 128 of the orienting sleeve 122 includes another valve (not shown) similar to valve 330 to further restrict movement of the cement liner 120 from the second end 128 to the first end 134 of the orienting sleeve 122. Each valve utilized in the orienting sleeve 122 or the float shoe 126 is a plunger valve, however, may include any other type of valve capable of performing the function thus described.

A guide 360 is positioned within the orienting sleeve 122 by heating the orienting sleeve 122, inserting the guide 360 and cooling the orienting sleeve 122 to secure the guide 360 in position. The guide 360 may, however, be secured within the orienting sleeve 122 by any other conventional means. The guide 360 includes a passage (not shown) for receipt of the lower end 326 of the orienting sleeve 122. Likewise, the lower end 326 is partially circumscribed by a reciprocating guide 364. The guide 360 and reciprocating guide 364 each include an orienting surface 366 and 368, respectively. Each orienting surface 366, 368, commonly referred to as a muleshoe, has a curvilinear edge 367 and 369 that tapers to form a curved end 370 and 372, respectively. The guide 360 is thus positioned within the orienting sleeve 122 to permit a portion of the fluid passage 368 to extend longitudinally beyond and below the guide 360 when the orienting surfaces 366 and 368 are substantially engaged.

Each curved end 370, 372 enables the sealing member 124 and orienting sleeve 122 to rotate as each curved end 370, 372 comes into contact with the corresponding orienting surface 366, 368 until substantially engaged as shown in FIG. 3. When the guide 360 and reciprocating guide 364 are substantially engaged, the shoulder 322 of the sealing member 124 is substantially supported by the engaged seat 320 of the orienting sleeve 122.

Figure 5:
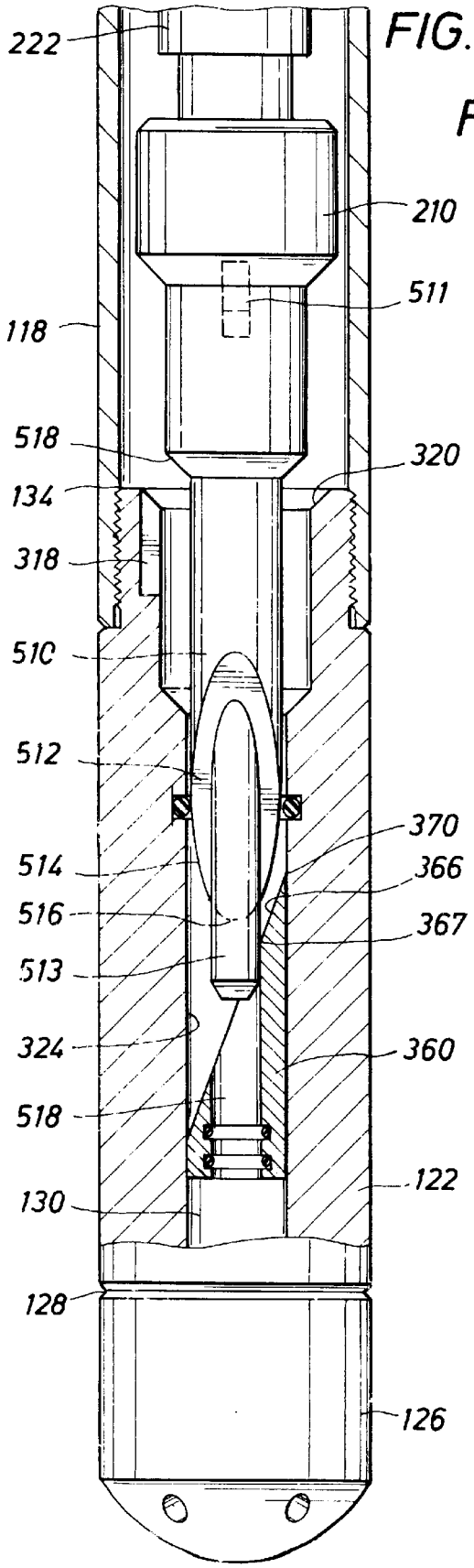
FIG. 5—is a detailed cross-sectional view of the orienting sleeve in partial engagement with the orienting member shown in FIG. 2.
Figure 6:
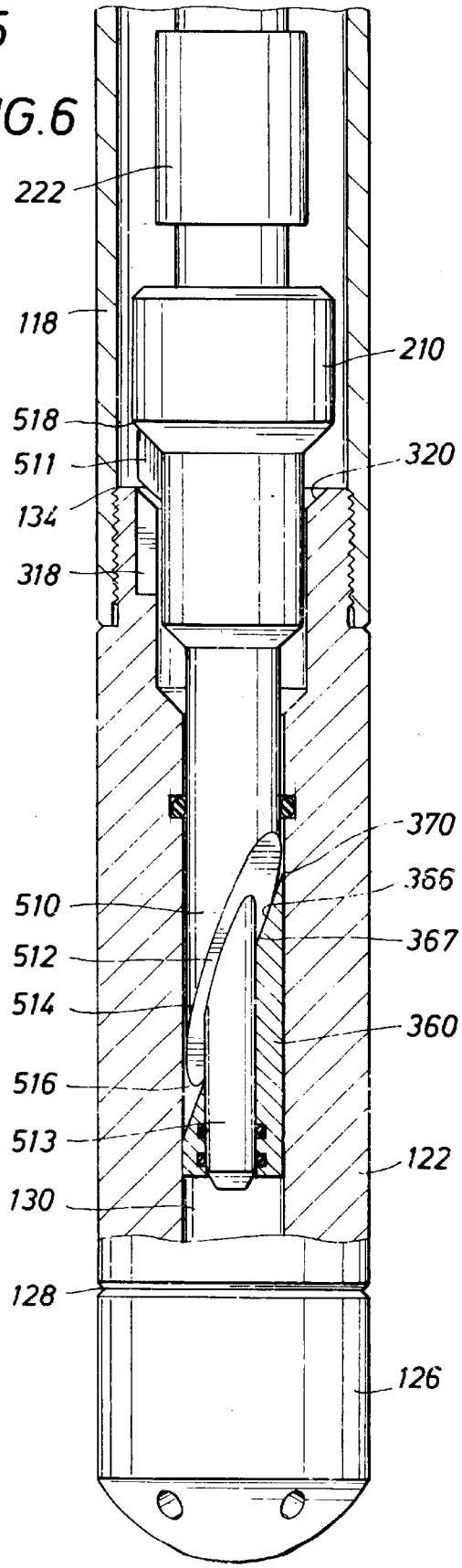
FIG. 6—is a detailed cross-sectional view of the orienting sleeve in further partial engagement with the orienting member shown in FIG. 2.
Figure 7:
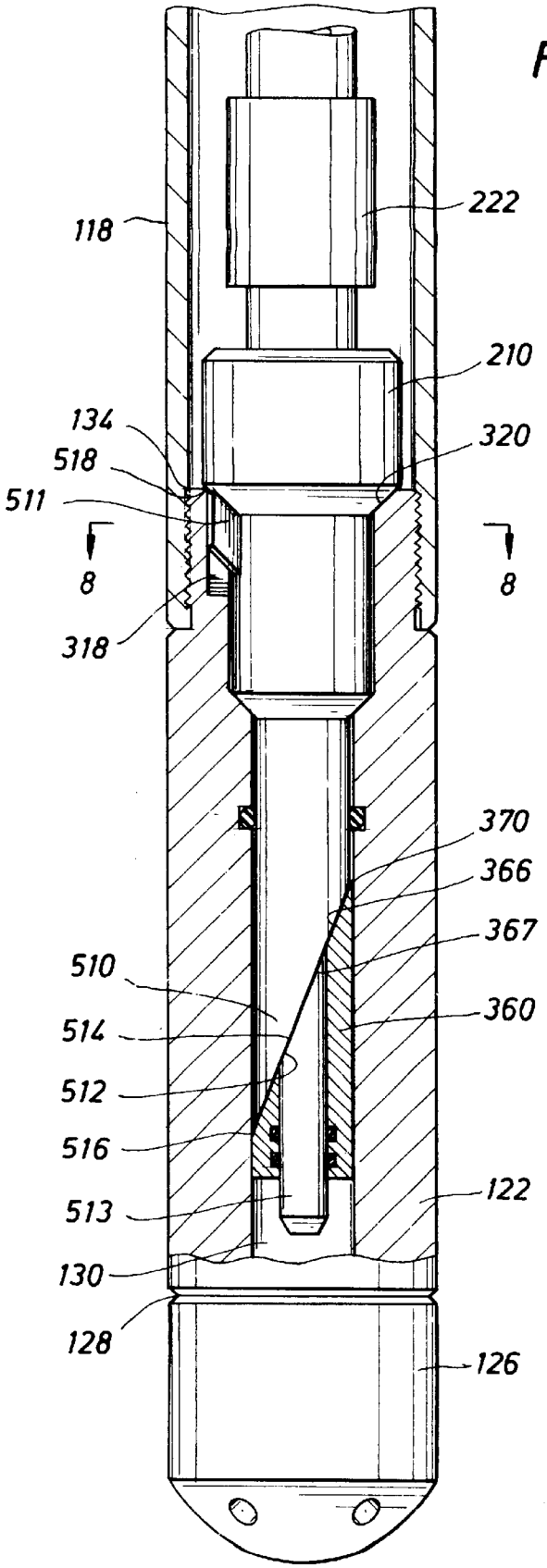
FIG. 7—is a detailed cross-sectional view of the orienting sleeve in substantial engagement with the orienting member shown in FIG. 2.

The primary function of the guide 360 is to align the orienting member 210 and orienting sleeve 122, as described in reference to FIGS. 5, 6 and 7. Although not typically required, however, the sealing member 124 and orienting sleeve 122 may be aligned when the orienting surfaces 366, 368 are substantially engaged.

A pair of o-ring seals 356 and 358 are positioned between the lower end 326 of the sealing member 124 and guide 360 in order to mitigate any back-flow of the cement liner 120 between the lower end 326 and guide 360. Another o-ring seal 362 is positioned between the orienting sleeve 122 and reciprocating guide 364 in order to mitigate any back-flow of the cement liner 120 between the orienting sleeve 122 and the reciprocating guide 364 as shown in reference to FIG. 4.

Referring now to FIGS. 5, 6 and 7, an orienting member 210 is shown in various positions relative to a cross-sectional view of the orienting sleeve 122. The orienting member 210 includes a flange 511 which substantially prevents rotational movement of the orienting member 210 when the flange 511 is disposed substantially within the channel 318 as shown in to FIG. 7 In FIG. 7, the orienting sleeve 122 and orienting member 210 are shown aligned. Although it is not always necessary to restrict rotational movement of the sealing member 124 shown in FIG. 3, a flange (not shown) may be attached by any conventional means to the sealing member 124 in order to restrict rotational movement of the sealing member 124 in the manner thus described.

The orienting member 210 includes a stinger 513 which is used to stab and locate the orienting sleeve 122. Typically, the stinger 513 contacts the seat 320 of the orienting member 210 causing the stinger 513 to align within the passageway 130 in the first end 134 of the orienting sleeve 122. The orienting member 210 also includes a reciprocating guide 510 which partially circumscribes the stinger 513. The reciprocating guide 510 includes an orienting surface 512 commonly referred to as a muleshoe. The orienting surface 512 has a curvilinear edge 514 that tapers to form a curved end 516. The curvilinear edge 514 and curved end 516 guide the orienting member 210 into alignment with the orienting sleeve 122 as shown in FIG. 7. The curved end 516 contacts a portion of the orienting surface 366 which causes the orienting member 210 to rotate counterclockwise as shown in FIG. 6. If the curved end 516 meets the curved end 370 on the guide 360, then the orienting member 210 is forced to rotate in either direction (clockwise or counterclockwise) as it is forced toward the second end 128 of the orienting sleeve 122. As the reciprocating guide 510 traverses down through the passage 130, the stinger 513 enters passage 518 in the guide 360 shown in FIG. 5.

In FIG. 7, the orienting surface 512 traverses the orienting surface 366 until the guide 360 and reciprocating guide 510 are substantially engaged. Once the guide 360 and reciprocating guide 510 are substantially engaged, the flange 511 will be substantially disposed within the channel 318 and a shoulder 518 on the orienting member 210 will be substantially supported by the engaged seat 320. Once the flange 511 is substantially disposed within the channel 318, the orienting member 210 and orienting sleeve 122 are aligned and the orienting member 210 is oriented in a predetermined lateral position relative to a lateral position on the casing 118 which defines the lateral position of the opening 208 shown in FIG. 2.

Figure 8:
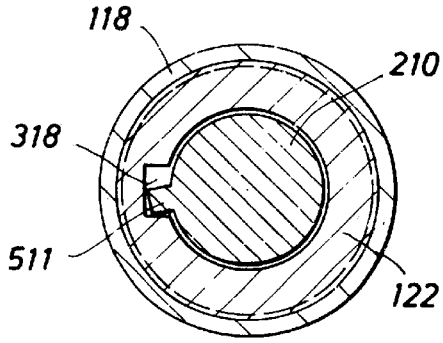
FIG. 8—is a cross-sectional view of the orienting sleeve and orienting member shown in FIG. 7 along 8—8.

Referring now to FIG. 8, the channel 318 is slightly larger than the flange 511 which enables the flange 511 to enter the channel 318 before the guide 360 and reciprocating guide 510 are substantially engaged. Consequently, nominal rotational movement of the orienting member 210 will occur once the guide 360 and reciprocating guide 510 are substantially engaged, however, will not compromise the ability to locate the lateral position of the opening 208 shown in FIG. 2. In FIGS. 5–7, the channel 318 defines the lateral reference point and a portion of the orienting sleeve 122 between the first end 134 and the second end 128 defines the longitudinal reference point. Preferably, the first end 134 or the second end 128 is chosen to define the longitudinal reference point.

Referring now to FIGS. 9 and 10, another embodiment of an orienting member 910 is shown in various positions relative to another embodiment of an orienting sleeve 912. In this embodiment, the orienting sleeve 912 includes a key 914 instead of the guide 360 shown in FIG. 3. The key 914 acts as a guide for the orienting member 910. The orienting sleeve 912 is identical in all other respects to the orienting sleeve 122 in FIG. 3, except that it includes a pair o-ring seals 916 and 918 above the key 914 which restrict the cement liner 120 from passing between the orienting sleeve 912 and the sealing member 124 described in reference to FIG. 3. Accordingly, the orienting sleeve 912 includes a channel 920 for receipt of a flange 922 attached to the orienting member 910 by any conventional means. The orienting sleeve 912 includes a seat 924 to support the orienting member 910 when the seat 924 and a shoulder 926 on the orienting member 910 are engaged.

The orienting member 910 is similar in most respects to the orienting member 210 described in reference to FIG. 5, except that a channel forming a keyway 930 is positioned in a lower end 928 of the orienting member 910. The lower end 928 partially circumscribes a stinger 948. The keyway 930 includes an end stop 932 which contacts an upper surface 934 of the key 914 when the orienting member 910 and orienting sleeve 912 are aligned as shown in FIG. 10. The lower end 928 includes an orienting surface 936 similar to that described in reference to FIG. 5, except that the curvilinear edge 938 tapers to form a pointed tip 940 which prevents jamming the orienting member 910 when the tip 940 meets the upper surface 934.

As shown in FIG. 9, the curvilinear edge 938 transitions into the keyway 930 through a transition surface 942 which permits the key 914 to traverse the orienting surface 936 and keyway 930 as the orienting member 910 passes through the first end 944 toward the second end 946 of the orienting sleeve 912. The stinger 948 is used to stab and locate the orienting sleeve 912 in order to position the orienting member 910.

In FIG. 10, the orienting member 910 is substantially engaged with the orienting sleeve 912 as shown by contact between the shoulder 926 and seat 924 of the orienting sleeve 912. At this position, the orienting member 910 is aligned with the orienting sleeve 912 and substantially free from rotational movement. Accordingly, the key 914 is engaged with the end stop 932 at this position. The end stop 932 is positioned at a distal end of the keyway 930 so that when the key 914 contacts the end stop 932, the flange 922 should be substantially disposed within the channel 920.

In FIGS. 9–10, the channel 920 or the key 914 defines the lateral reference point and a portion of the orienting sleeve 912 between the first end 944 and the second end 946 defines the longitudinal reference point. Preferably, the first end 944 or the second end 946 is chosen to define the longitudinal reference point.

Referring now to FIG. 2, an elevational view of the orienting sleeve 122 is shown in connection with the orienting member 210 and other components needed to locate the lateral position and longitudinal position of an opening 208. Once the casing 118 has been secured within the wellbore 112, the sealing member 124 shown in FIG. 1 is removed from wellbore 112 and replaced with the components shown in FIG. 2.

The components shown in FIG. 2 include a diverter 234, an extension member 216, and the orienting member 210. These components are lowered into the casing 118 using the drill string 138 which is operatively and releaseably connected to the diverter 234. Because a directional survey has already been performed to position the orienting sleeve 122 at a predetermined depth and lateral orientation within the wellbore 112, another directional survey is unnecessary.

Before these components are lowered into the casing 118, the face 232 of the diverter 234 is aligned with the first lateral position and the first longitudinal position which define the opening 208 next to a desired area of the formation 214. As described in reference to FIG. 1, the exact longitudinal position and lateral position of the opening 208 are determined before the casing 118 is secured to the wellbore 112. Thus, the longitudinal position and lateral position of the opening 208 can be measured from the predetermined longitudinal reference point (128 or 134 in FIG. 5) and lateral reference point (318 in FIG. 5), respectively. The diverter 234 is aligned with the longitudinal position of the opening 208 using the extension member 216 and the face 232 of the diverter 234 is aligned with the lateral position of opening 208 using unilateral connections and a multilateral connection, in the manner described in reference to U.S. Pat. No. 6,427,777. The length of the extension member 216 can be varied by using shorter or longer components 218, 220 and 236. Each unilateral connection 222 maintains alignment between the orienting member 210 and the face 232 of the diverter 234 in a single lateral direction. The multilateral connection 230 permits the alignment maintained by the unilateral connections to be adjusted in pre-selected increments.

Once the components in FIG. 2 are made up in the manner thus described, the components are lowered into the wellbore 112 until the orienting member 210 substantially engages the orienting sleeve 122 and the face 232 of the diverter 234 is aligned with the opening 208. An anchor 238 may be used when the extension member 216 is extremely long and needs additional support. The drill string 138 is disconnected from the diverter 234 by compressing the system. Once disconnected, the probe 242 engages the face 232 of the diverter 234 causing the probe 242 to bore through the fiberglass mesh 136, cement liner 120 and desired formation 214.

The present invention may also be used in applications where there is no opening 208 in the casing 118 and the lateral well 212 is formed in two separate runs because two different probes 240 are used. Two separate runs are required because the first probe used to mill through the casing 118 must be removed at the surface 114 and replaced with another probe used to drill to drill through formation 214. In this event, the directional survey results are used to generally determine the lateral position and longitudinal position of a desired area in the formation 214 relative to the longitudinal reference point and lateral reference point on the orienting sleeve 122. In this manner, the face 232 of the diverter 234 can be aligned with these coordinates to begin formation of the lateral well.

Once the lateral well 212 is formed, the drill string 138 and probe 242 are removed from the wellbore 112, and the orienting member 210, extension member 216, and diverter 234 are retrieved. The process is repeated for each desired lateral well. Accordingly, another lateral well may be formed by simply adjusting the length of the extension member 216 and lateral orientation of diverter 234. For example, if another opening (not shown) in the casing 118 is used to form another lateral well (not shown), the extension member 216 may be shortened or lengthened to align the face 232 of the diverter 234 with the longitudinal position of the new opening relative to the longitudinal reference point and the multilateral connection 230 may be adjusted to align the face 232 of the diverter 234 with the lateral position of the new opening relative to the lateral reference point. Alternatively the extension member 216 may be shortened or lengthened to align the face 232 of the diverter 234 with the longitudinal position of the new opening relative to the longitudinal position of the opening 208 and the multilateral connection 230 may be adjusted to align the face 232 of the diverter 234 with the lateral position of the new opening relative to the lateral-position of the opening 208.

Because the orienting sleeve 122 is designed for receipt of the sealing member 124 in FIG. 3 and the orienting member 210 in FIG. 5, the wellbore 112 and a lateral wellbore 212 may be completed in a more economic and efficient manner—particularly when one or more openings like the opening 208 are utilized to eliminate the step of milling through the casing 118. Moreover, the orienting sleeve 122 provides a lateral reference point and longitudinal reference point to locate the longitudinal position and lateral position of the opening 208 in the casing 118 which cannot be accurately located using other conventional methods and equipment.

Although the objects and advantages of the present invention have been described in detail, those skilled in the art should understand that they can make various changes, substitutions and alterations herein without departing from the spirit and scope of the present invention in its broadest form.

I claim:

1. An orienting sleeve for use in a wellbore lined with casing, the orienting sleeve comprising:

a) a first end;

b) a second end having a valve, the valve permitting movement of a fluid from the first end of the orienting sleeve to the second end of the orienting sleeve and restricting movement of the fluid from the second end of the orienting sleeve to the first end of the orienting sleeve;

c) a longitudinal reference point for enabling the location of a longitudinal position on the casing; and d) a lateral reference point for enabling the location of a lateral position on the casing.

2. The orienting sleeve of claim 1, wherein a portion of the first end forms a seat for engagement with a shoulder of at least one of a sealing member and an orienting member, the orienting member enabling the location of the lateral position and the longitudinal position, the sealing member having a fluid passage therethrough for transferring the fluid from a surface above the wellbore to a space between the casing and the wellbore, the fluid securing the casing to the wellbore.

3. The orienting sleeve of claim 2, further comprising a seal to restrict the fluid from passing between the orienting sleeve and the sealing member.

4. The orienting sleeve of claim 1, wherein the first end is connected to the casing and the second end is connected to a float shoe having another valve, the another valve permitting movement of the fluid from the first end of the orienting sleeve through the float shoe and restricting movement of the fluid from the wellbore through the float shoe.

5. The orienting sleeve of claim 1, wherein the lateral position and the longitudinal position define an opening in the casing.

6. The orienting sleeve of claim 2, further comprising a guide having a passage therethrough for receipt of a lower portion of at least one of the sealing member and the orienting member, the at least one of the sealing member and the orienting member having a reciprocating guide for aligning the at least one of the sealing member and the orienting member with the orienting sleeve when the guide and reciprocating guide are substantially engaged.

7. The orienting sleeve of claim 6, wherein the first end includes a channel extending longitudinally toward the second end of the orienting sleeve, the channel having an opening in the seat for receipt of a flange connected to at least one of the sealing member and the orienting member when the at least one of the sealing member and the orienting member are aligned with the orienting sleeve, the flange substantially preventing rotational movement of the at least one of the sealing member and the orienting member when the flange is disposed substantially within the channel.

8. The orienting sleeve of claim 2, further comprising a key, at least one of the sealing member and the orienting member having a guide with a keyway for aligning the at least one of the sealing member and the orienting member with the orienting sleeve when the key enters the keyway.

9. The orienting sleeve of claim 8, wherein the first end includes a channel extending longitudinally toward the second end of the orienting sleeve, the channel having an opening in the seat for receipt of a flange connected to at least one of the sealing member and the orienting member when the at least one of the sealing member and orienting member are aligned with the orienting sleeve, the flange substantially preventing rotational movement of the at least one of the sealing member and the orienting member when the flange is disposed substantially within the channel.

10. The orienting sleeve of claim 7, wherein the channel defines the lateral reference point.

11. The orienting sleeve of claim 9, wherein at least one of the channel and the key defines the lateral reference point.

12. The orienting sleeve of claim 1, wherein at least a portion of the orienting sleeve between the first end and the second end defines the longitudinal reference point.

13. The orienting sleeve of claim 1, wherein the valve is a type of plunger valve.

* * * * *

UNITED STATES PATENT AND TRADEMARK OFFICE

CERTIFICATE OF CORRECTION

PATENT NO. : 6,622,792 B1
DATED : September 23, 2003
INVENTOR(S) : Robert C. Schick It is certified that error appears in the above-identified patent and that said Letters Patent is hereby corrected as shown below:

Column 3,
Line 52, should read -- sleeve and the sealing member. --

Signed and Sealed this

Ninth Day of December, 2003

JAMES E. ROGAN
*Director of the United States Patent and Trademark Office*